United States Patent [19]

Moulding, Jr. et al.

[11] Patent Number: 4,604,847

[45] Date of Patent: Aug. 12, 1986

[54] MEDICINE PACKAGE, METHOD OF OPENING THE PACKAGE, AND MACHINE FOR PERFORMING THE METHOD

[76] Inventors: Thomas S. Moulding, Jr., 1954 Glencoe St., Denver, Colo. 80220; Donald G. Ellis, Geneva Park, Boulder, Colo. 80302

[21] Appl. No.: 532,038

[22] Filed: Sep. 14, 1983

[51] Int. Cl.[4] ..... B65B 43/26

[52] U.S. Cl. ..... 53/75; 53/381 R; 30/2; 83/63; 83/367; 83/371; 83/440; 83/467 A

[58] Field of Search ..... 53/381, 381 A, 75, 76, 53/492; 83/440, 71, 63, 67, 73, 367, 371, 440, 467 A; 30/2, 289, 436, 405, 401; 414/412

[56] References Cited

U.S. PATENT DOCUMENTS

| | | | |
|---|---|---|---|
| 1,919,907 | 7/1933 | Robinson | 30/2 |
| 2,110,194 | 3/1938 | Blier | 30/2 |
| 2,247,840 | 7/1941 | Harrison | 30/289 |
| 2,523,810 | 9/1950 | Brown | 30/436 X |
| 3,199,450 | 8/1965 | Leavens | 83/371 X |
| 3,429,042 | 2/1969 | Lawrence et al. | 30/436 X |
| 3,488,479 | 1/1970 | Keyes et al. | 83/71 X |
| 4,177,726 | 12/1979 | Kinard | 414/412 X |
| 4,428,709 | 1/1984 | Peters | 53/381 R X |
| 4,449,433 | 5/1984 | Miyamoto | 83/371 X |

*Primary Examiner*—Horace M. Culver

[57] ABSTRACT

A medicine package including a reservoir containing the medicine, the package bearing a machine readable code indicative of the characteristics of the medicine contained therein. If from reading the code it is determined that the medicine contained in the package can be used to satisfy the needs of a particular patient, then the package is opened and the code is rendered unreadable by the machine. A machine for reading the code, opening the package, rendering the code unreadable, and maintaining a record of the dispensing of the medicine to a particular patient is also disclosed.

126 Claims, 25 Drawing Figures

MEDICINE PACKAGE, METHOD OF OPENING THE PACKAGE, AND MACHINE FOR PERFORMING THE METHOD

BACKGROUND OF THE INVENTION

The dispensing of medication, especially in hospitals, nursing homes and the like, presently involves archaic, labor intensive, error prone procedures.

The traditional method of dispensing medication on hospital floors requires the nurses on each shift to deposit the prescribed amount of medication for a particular patient into a cup. At the appropriate time, the nurse takes the medication filled cup to the designated patient and records on a chart the amount and kind of medication given to the patient, the time when the medication is given, and the identity of the patient to whom the medication is given. In many hospitals and nursing homes over thirty percent of nursing time is spent dispensing and recording the dispensing of medication, thereby contributing to the ever increasing cost of medical care and diverting nursing skills from more important functions and duties. Moreover, such traditional method of dispensing medication permits human error in any one of several steps of the method such as selecting the proper medication from several available medications, calculating the proper amount of medication, delivering the medication to the proper person, delivering the medication at the proper time, accurately and completely recording or "charting" the above-mentioned data concerning the dispensing of the medication, maintaining the physical copy of the record in the patient's chart or in a file, etc.

Sometimes medication is left at the bedside of hospital patients who are not critically ill and who are considered to be of sound mind and reliable for self administration of the medicine by the patients. However, these patients often will not take the medication as directed, and thus, no accurate record of medication actually ingested can be made.

Patients living at home are often left with the responsibility of following directions to take medication. In addition to those circumstances where such patients intentionally fail to follow the instructions, such patients, especially feeble minded or elderly patients, often forget to take the medicine, take the wrong amount of medication, take the medication at the wrong time, take one medication according to the instructions for another medication, etc. Many patients are forced into nursing homes and sometimes into hospitals solely to insure that they take medication according to prescribed instructions. Such a forced residence can be cruel to a patient who wants to stay home and is oppressively expensive for those persons or entities who pay for the hospital or nursing home stay.

SUMMARY OF THE INVENTION

The present invention relates to a package containing medicine, the package being constructed so that it is difficult to open the package without passing the package through a cutting machine to which the present invention also relates. The package bears a machine readable code indicating the characteristics of the medicine contained within the package. The cutting machine includes a means for reading the machine readable code, a unique cutting means specifically adapted for cutting the package, and if desired a means for selectively permitting the package to be severed. The means for permitting the package to be severed by the unique cutting means is responsive to certain conditions concerning a particular patient's medical needs, such as the patient's identity, the characteristics of the medicine which the patient needs, the time when the person needs the medicine, etc. These conditions can be stored in a computer controller located within the cutting machine or operatively connected to the cutting machine from a remote location. If all of the conditions are not satisfied, then the computer controller in combination with the severance permitting means will not permit the package to be severed by the unique cutting means. If all of the conditions are met, then the computer controller in combination with the severance permitting means will permit the package to be severed by the unique cutting means. The cutting machine may be provided with means for recording the characteristics of the medicine in the package as indicated by the machine readable code, the time when the code was read, the identity of the patient, etc. Thus, the present invention provides a system for effective regulation, monitoring and accounting of the dispensing of medication to a patient.

BRIEF DESCRIPTION OF THE DRAWINGS

The invention will be described with reference to the accompanying drawings, wherein.

FIG. *7a* is a front view of another medicine package for bottled medicine according to another embodiment of the present invention;

FIG. *7b* is a side view of the medicine package shown in FIG. *7a;*

Figure 8:
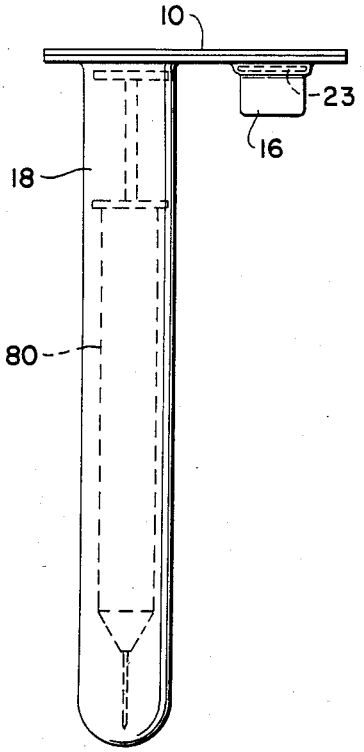
Figure 9:
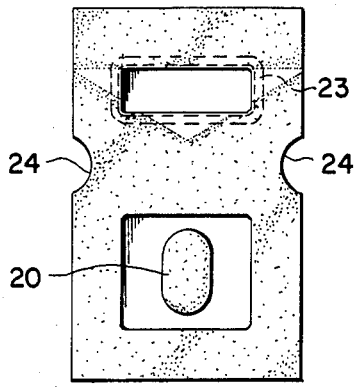
Figure 10:
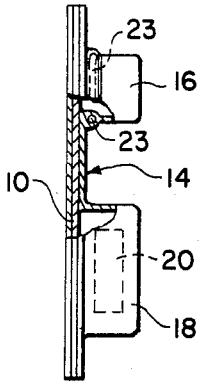
Figure 11:
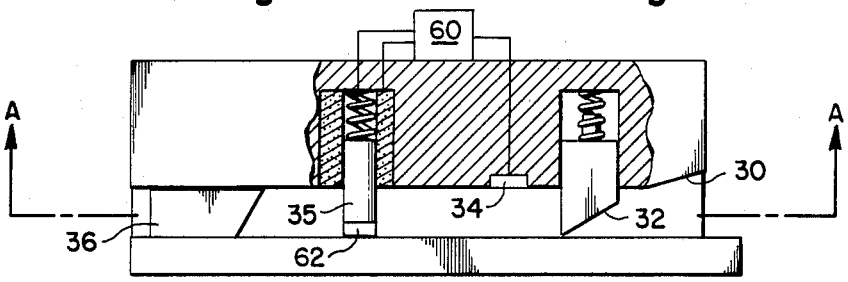
Figure 12:
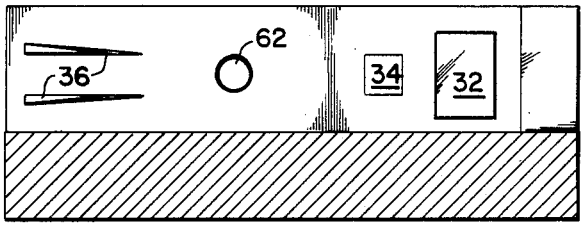
Figure 13:
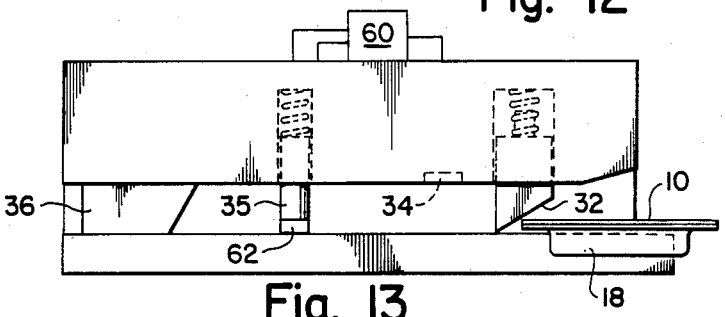
Figure 14:
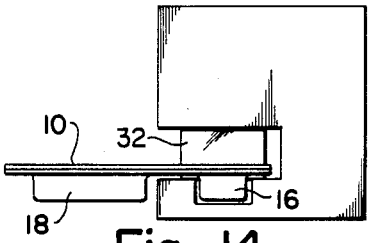
Figure 15:
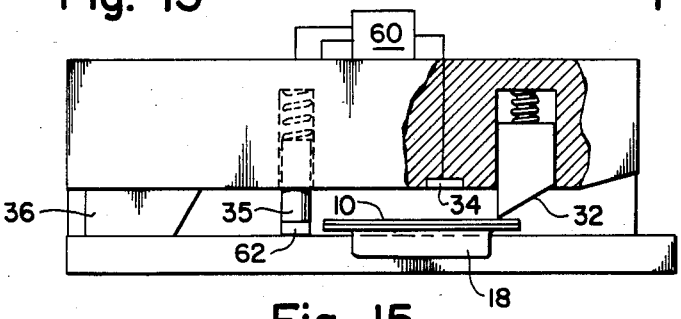
Figure 16:
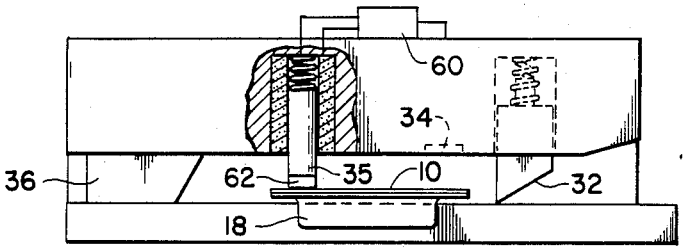
Figure 17A:
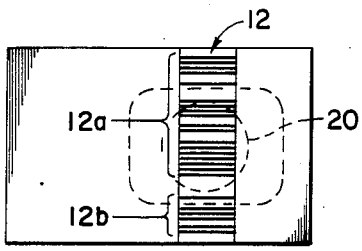
Figure 17B:
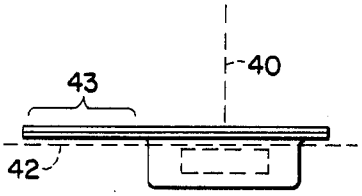
Figure 17C:
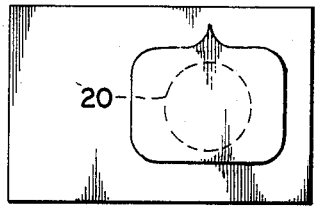
Figure 18:
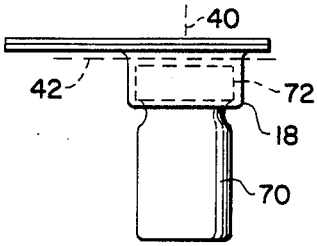
Figure 19:
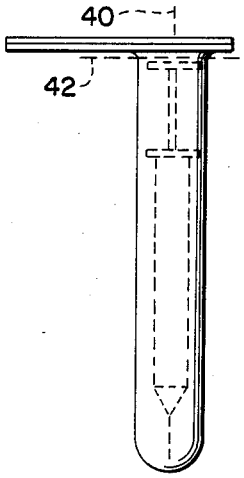
Figure 20:
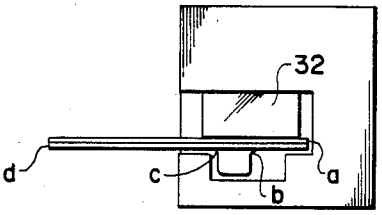
Figure 21:
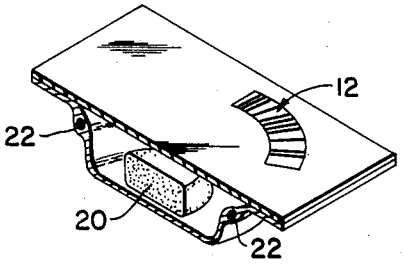
Figure 22:
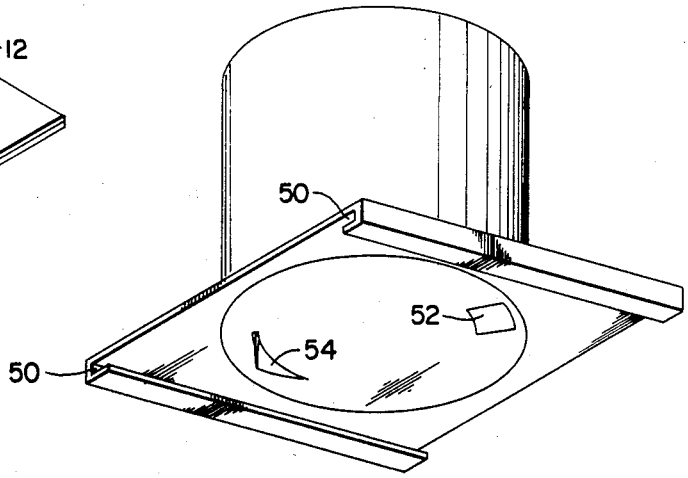

FIG. 8 is a side view of another medicine package for a syringe containing medicine according to another embodiment of the present invention;

FIG. 9 is a front view of another medicine package in accordance with yet another embodiment of the present invention with the covering removed to expose the areas of adhesion;

FIG. 10 is a side view of the medicine package shown in FIG. 9 including the covering;

FIG. 11 is a schematic illustration of a cross sectional side view of a cutting machine in accordance with one embodiment of the present invention;

FIG. 12 is a schematic illustration of the cutting machine shown in FIG. 11 as taken along the line A—A;

FIG. 13 is a schematic illustration of the cutting machine according to FIG. 9 showing the position of a medicine package according to FIGS. 1 through 10 as it first enters the cutting machine;

FIG. 14 is a schematic illustration of an end view of the cutting machine and medicine package shown in FIG. 13;

FIGS. 15 and 16 are schematic illustrations of the cutting machine according to FIG. 13 showing the progress of the medicine package as it advances through the cutting machine;

FIG. 17*a* is a top view of yet another medicine package in accordance with still another embodiment of the present invention;

FIG. 17*b* is a side view of the medicine package shown in FIG. 17*a* including schematic severing lines;

FIG. 17*c* is a bottom view of the medicine package shown in FIGS. 17*a* and 17*b* illustrating the acute edge of the reservoir forming depression;

FIG. 18 is a side view of another medicine package for bottled medicine according to another embodiment of the present invention;

FIG. 19 is a side view of another medicine package for a syringe containing medicine according to another embodiment of the present invention;

FIG. 20 is a schematic end view of a cutting machine similar to that shown in FIG. 11 and a medicine package in accordance with still another embodiment of the present invention;

FIG. 21 is a cross sectional perspective view of yet another medicine package in accordance with yet another embodiment of the present invention; and FIG. 22 is a schematic illustration of a perspective view of another cutting machine in accordance with another embodiment of the present invention.

DESCRIPTION OF A PREFERRED EMBODIMENT

Referring now to the drawings wherein like reference numerals and symbols refer to the same item, there is shown in FIGS. 1 through 6, a medicine package according to one embodiment of the present invention. The medicine package includes a sheet like covering 10 bearing a code, such as a machine readable code 12. The code 12 may comprise a main code 12*a* and an end code 12*b*. The code 12 may comprise a series of spaced bars (or bar code), as depicted in the drawings, or may comprise some other code such as a magnetic code. The medicine package also includes a formed section 14 including a first reservoir forming depression 16 disposed near an upper end thereof and a second, larger reservoir forming depression 18 disposed near the bottom end thereof. The second reservoir forming depression 18 is adapted to receive medicine in the form of a pill 20, capsule, tablet, suppository or the like. The covering 10 and the formed section 14 preferably are each fashioned of a tough, semi-rigid plastic.

Figure 1:
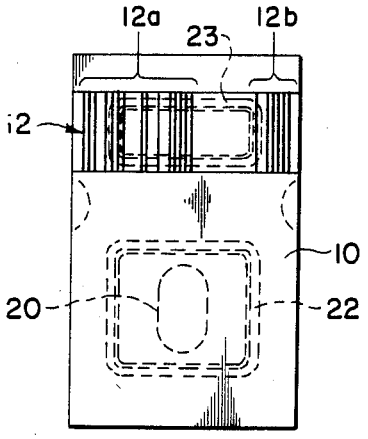
FIG. 1 is a front view of a medicine package in accordance with one embodiment of the present invention.
Figure 2:
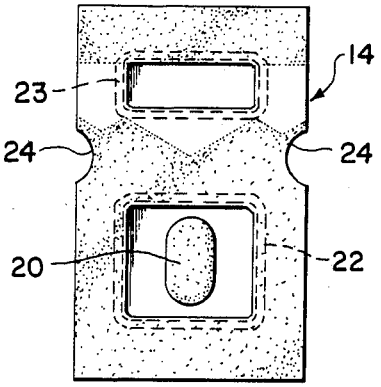
FIG. 2 is a front view of the medicine package shown in FIG. 1 with the covering removed to expose the areas of adhesion.
Figure 3:
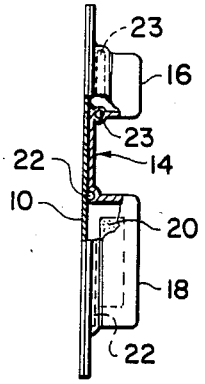
FIG. 3 is a side view of the medicine package shown in FIG. 1.

The covering 10 is preferably maintained in a sealing relation against the formed portion 14 by means of an adhesive. The adhesive is preferably applied between the covering 10 and the formed portion 14 as shown in FIG. 2, that is, in the regions of the package surrounding the second reservoir forming depression 18 and between the first reservoir forming depression 16 and its associated upper package end. The code bearing portion of the covering 10 is generally disposed above the first reservoir forming depression 16 and generally is not in contact with the area where adhesive is present. Because of the location of the adhesive, it is quite difficult to peel the covering 10 from the formed portion 14 without cutting the package in a manner to be described later herein.

The medicine package preferably includes a ring 22 disposed adjacent to the covering 10 in a correspondingly shaped depression around the wall of the second reservoir forming depression 18. Alternatively, the ring 22 may be embedded in the wall of the second reservoir forming depression 18. The ring 22 preferably is fashioned of wire, fiberglass, or other strong material and substantially prevents the medicine package from being severed in the region of the medicine 20 by conventional cutting means such as scissors. A similar ring 23 is disposed near the covering 10 in a correspondingly shaped depression around, or alternatively embedded in, the wall of the first reservoir forming depression 16. The ring 23 serves a function similar to that served by the ring 22.

Figure 4:
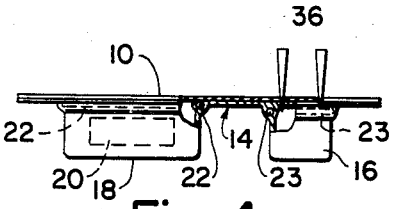
FIG. 4 is a side view of the medicine package shown in FIG. 1 illustrating two knives or blades in position for cutting a portion of the covering bearing the machine readable code.
Figure 5:
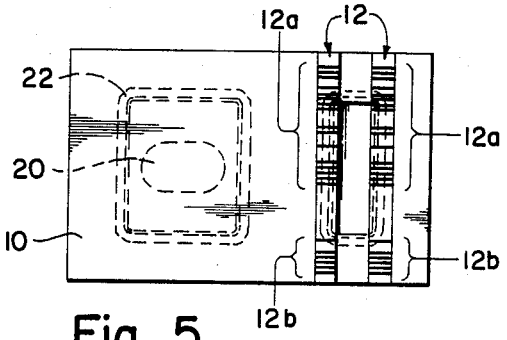
FIG. 5 is a front view of the medicine package shown in FIG. 1 with a strip of the covering bearing the machine readable code having been cut and removed from the package.
Figure 6:
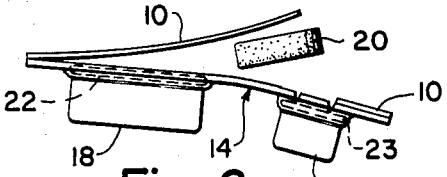
FIG. 6 is a side view of the medicine package shown in FIG. 5 after the covering has been pried and peeled from the remaining portion of the medicine package.

FIG. 4 shows a pair of spaced knives or blades 36 utilized in opening the medicine package. The blades 36 slice the covering 10 as well as a portion of the walls of the first reservoir forming depression 16 across the width of the covering bearing the machine readable code 12. The positions of the blades 36 and the ring 23 are such that the ring 23 does not interfere with the slicing performance of the blades 36. Since the portion of the covering 10 between the blades 36 is not adhered to the formed portion 14, the action of the blades 36 produces a strip of covering 10 which is freely removed from the medicine package. Thereafter, the medicine package may be opened to expose and remove the pill 20 contained therein by prying apart the upper end of the formed section 14 and the upper edge of the lower portion of the covering 10. Such prying action allows the lower portion of the covering 10 to be peeled from the formed portion 14. To assist such peeling action, the edges of the formed portion 14 below the first reservoir forming depression 16 may be provided with indentations 24 as shown in FIG. 2 so that fingers of a human can grip the covering 10 without simultaneously gripping the formed portion 14. The upper boundary of the bottom adhesive layer is angular to facilitate the separation of the covering 10 from the formed portion 14 so that the peeling action can be initiated.

Figure 7A:
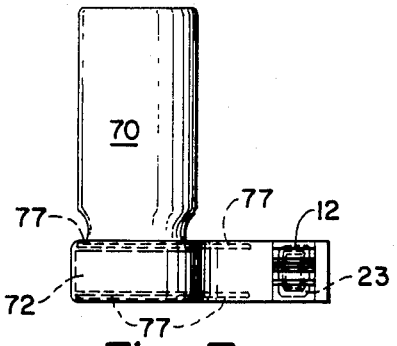
Figure 7B:
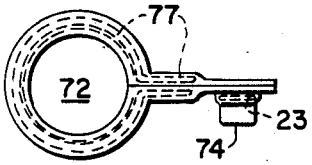

Medicine contained in a bottle or other container, especially fluid medicine, can be dispensed by a medicine package similar to that just described with reference to FIGS. 1 through 6. Such a medicine package is shown in FIGS. 7*a* and 7*b* for use with a bottle 70 having a conventional twist-off cap 72 and fashioned with a relatively narrow, indented neck portion located immediately below the cap 72. The medicine package includes a single sheet of material having a reservoir forming depression 74 disposed near a first longitudinal end thereof. The sheet is looped in its center region so that the second longitudinal end overlaps the first longitudinal end. The ends may be adhered in the manner described above with respect to FIG. 2 or described hereinafter with respect to FIG. 9, and the sheet may be provided with a code also in the manner described above with respect to FIGS. 1 through 6. The central region of the sheet is fashioned such that the lateral edges form a smaller diameter loop than the loop diameter in the interior of the sheet central region, thereby ensuring that the bottle cap is maintained within the looped portion of the medicine package. It will be appreciated that the narrow, indented bottle neck facilitates such maintenance. A split wire ring 77 similar to that previously described may be placed in a depression immediately inside of each lateral edge of the sheet in the loop area and extending into the overlapping area to substantially prevent the package from being severed in the loop region or overlapping area by conventional cutting means such as scissors. Alternately the sheet may be made of metal, fiberglass or other strong material to substantially prevent such severing by conventional cutting means. The medicine package may be opened in the manner previously described with respect to FIGS. 1 through 6. It should also be appreciated that the cap 72 of the bottle 70 may be maintained likewise within the second reservoir forming depression 18 of the medicine package shown in FIGS. 1 through 6, as exemplified in FIG. 18.

Medicine contained in a syringe 80 can be dispensed by a medicine package shown in FIG. 8. Such medicine package is similar to that just described with reference to FIGS. 1 through 6, with the second reservoir forming depression 18 being shaped generally conformingly with the syringe 80 which it contains. The syringe 80 can be any standard syringe, including a TUBEX brand syringe, and preferably is disposable. A similar package could be used to contain an entire bottle of medicine.

A slightly modified version of the medicine package shown in FIGS. 1 through 6 is shown in FIGS. 9 and 10. It will appreciated from the discussion of FIGS. 1 through 6 and from the drawing of FIG. 2 that the medicine package could be opened without removing a strip of code bearing covering by inserting a sharp utensil such as a pin or knife between the covering 10 and the formed portion 14 along the lateral edges of the medicine package near the first reservoir forming depression 16, where there is no adhesive. The modified medicine package depicted in FIGS. 9 and 10 overcomes this disadvantageous feature of the medicine package depicted in FIGS. 1 through 6 by providing an adhesive between the covering 10 and the formed portion 14 lateral to the first reservoir forming depression 16. The modified medicine package includes two overlapping coverings 10, with the outer-most covering bearing the machine readable code 12. The two coverings may be secured such as by an adhesive in an overlapping relation so long as the severing of the outermost covering by the blades 36 permits the resulting code bearing covering strip to be freely disengaged from the medicine package. Here again the upper boundary of the bottom adhesive layer is angular to facilitate the separation of the covering 10 and the formed portion 14 so the peeling action may be initiated.

In yet another modified version of the medicine package, the first reservoir forming depression 16 is eliminated. The formed portion 14 is flat in the area where the first reservoir forming depression 16 otherwise would be located, and the covering 10 is sealed to the formed portion 14 with an adhesive much the same as depicted in FIG. 9. The medicine package would be opened by cutting with a knife through the code bearing region of the covering 10 without cutting through the formed portion 14. Once such cutting has been accomplished, the covering 10 may be grasped at the indentations 24 and then the covering 10 may be peeled from the formed portion 14 in the manner previously described for the other medicine packages.

FIGS. 11 through 16 illustrate a cutting machine that can be utilized in severing a strip of code bearing covering from the medicine packages shown in FIGS. 1 through 6, FIGS. 7 and 8 and in FIGS. 9 and 10. The cutting machine includes a central longitudinal passageway provided with a trough conformingly shaped with the first reservoir forming depression 16, as shown in FIG. 14. The mouth of the passageway includes an inclined section 30 to facilitate the reception of the first reservoir forming depression 16 in the trough of the passageway. Such reception is also facilitated by the trough's lateral protrusion from the remainder of the cutting machine. The cutting machine includes a first gate 32 disposed inwardly of the passageway mouth. The first gate 32 is spring biased into a position blocking the trough portion of the passageway. The first gate 32 is fashioned with an inclined section opening toward the passageway mouth, such that forceful pressing of the lateral edge of the medicine package near the first reservoir forming depression 16 inwardly against the first gate 32 causes the first gate 32 to be moved against its spring bias to a position where it does not block the passageway trough.

The cutting machine is also provided with a means for reading the machine readable code 12 provided on the medicine package. Such means is disposed inwardly of the first gate 32 and may comprise a scanner 34. Thus, as the first reservoir forming depression 16 passes inwardly of the first gate 32, the scanner 34 reads or deciphers the machine readable code 12. The scanner 34 may be actuated for a selected time duration by a predetermined movement of the first gate 32 against its spring bias.

A second gate 35 is disposed inwardly of the scanner 34 and may be selectively positioned either in the passageway trough or out of the passageway trough. As shown in FIGS. 11 through 13, 15 and 16, the second gate 35 is spring biased to a position in the passageway trough and may be selectively moved preferably by means of a solenoid to a position outside of the passageway trough in response to the reading of the code by the scanner 34. In one method and construction of the present invention, the second gate 35 can be fixedly positioned out of the passageway trough or eliminated entirely. In another embodiment of the present invention, means are provided to prevent the solenoid from being activated to raise the second gate 35 except for a selected time duration after the first gate 32 has been raised or after a portion of the code has been read. In another embodiment of the present invention, means are provided to prevent the solenoid from being activated to raise the second gate 35 except when the first gate 32 is raised.

The cutting machine also includes a pair of spaced knives or blades 36 disposed inwardly of the second gate 35. The knives 36 are provided with an inclined, sharp leading edge depending very slightly into the passageway trough. The rear edge of each knife is blunt and depends slightly into the passageway trough to prevent the first reservoir forming depression 16 from being inserted into the rear opening of the passageway. When the lateral edge of the medicine package near the first reservoir forming depression 16 passes beneath the second gate 35, as shown in FIG. 16, the medicine package can be moved further along the passageway trough so the blades 36 sever the covering 10 through the machine readable code 12 and such that a strip of code bearing covering freely disengages from the medicine package. Thereafter, the medicine package may be opened as discussed above with reference to FIGS. 5 and 6. The cutting machine may also be provided with a means (not shown) for automatically collecting the strip of code bearing covering as the covering 10 is severed by the blades 36.

The dimensions of the medicine package and the distance between the first gate 32 and the second gate 35 are chosen such that the first gate 32 moves into the passageway trough and prevents the backward movement of the first reservoir forming depression 16 once the leading lateral edge of the medicine package has passed beneath the second gate 35.

The portion of the cutting machine forming the passageway trough may be translatable with respect to the remaining portion of the cutting machine. In this embodiment of the invention, the first reservoir forming depression 16 is disposed within the trough and remains stationary with respect to the trough. The portion of the cutting machine forming the passageway trough and the medicine package are then together longitudinally translated with respect to the remaining portion of the cutting machine.

The cutting machine either may include or may be utilized with auxiliary equipment such as a computer controller, display screen and time indicating means operatively interconnected with the scanner 34 and the second gate 35. The computer controller may be programed with a variety of selected conditions that must be satisfied before the second gate 35 is permitted to be positioned out of the passageway trough. Such conditions may include a patient's identification, the characteristics (including quantity and kind) of medicine that the patient needs, the time intervals at which such medicine should be given to the patient, the time when the patient was last given the particular medicine, etc. Since the machine readable code 12 indicates characteristics (such as quantity and kind) of the medicine contained in the medicine package, the scanner 34 can decipher these characteristics. If the characteristics of the medicine in the medicine package do not satisfy the conditions, if the time when the code 12 is deciphered by the scanner 34 does not satisfy the conditions, or if any other condition is not satisfied, then the computer controller will not permit the solenoid to be activated to move the second gate 35 out of the passageway trough and the second gate 35 will obstruct forward movement of the first reservoir forming depression 16 in the passageway. If the second gate 35 is not moved out of the passageway trough, then the first gate 32 will be held in a position out of the passageway trough by the trailing lateral edge of the medicine package, thus allowing the medicine package to be retracted back through the mouth of the passageway. If the conditions are not satisfied, the computer controller can display on the display means the conditions that were not satisfied.

The position of the machine readable code 12, including the main code **12*a* and the end code 12*b*, and the scanner 34 are selected such that after the main code 12*a* is completely read by the scanner 34, the second gate 35 will be moved out of the passageway trough by activating the solenoid only if all conditions are satisfied. In one embodiment, the solenoid will be activated only if the first gate 32 is also raised. Further movement of the medicine package to a point where the leading lateral edge thereof lies beneath the second gate 35 causes the first gate 32 to drop into the passageway trough whereby the first reservoir forming depression 16 cannot move backward past the first gate 32**.

The main code **12*a* may contain the information respecting the characteristics of the medicine contained in the medicine package. The scanner 34 can completely read the main code 12*a* before an edge of the medicine package abuts or passes beneath the second gate 35. From reading the main code 12*a*, the computer controller determines whether the various conditions are satisfied. If the conditions are not satisfied, then the second gate 35 is not moved out of the passageway trough and the medicine package can be retracted back through the mouth of the passageway. If the conditions are satisfied, then the second gate 35 is moved out of the passageway trough to permit forward movement of the first reservoir forming depression 16 toward the knives 36. Such forward movement permits the scanner 34 to read the end code 12*b*, which signals the computer controller that an edge of the medicine package has passed beneath the second gate 35. When the end code 12*b* has been read by the scanner 34, the first gate will have moved into the passageway trough to prevent the medicine package from being retracted back through the mouth of the passageway, and the computer controller will record in its permanent memory all of the information associated with the medicine package, including the time the end code 12*b* was read, etc. It will be appreciated that the end code 12*b* is used to indicate the position of the medicine package in the passageway trough, especially the position when the medicine package is blocked by the first gate 32 from being retracted back through the passageway mouth and to indicate that the medicine package is beneath the second gate 35 to permit the medicine package to be passed forward through the cutting machine. Alternatively, the end code 12*b*** could be replaced by means for sensing the position of the medicine package in the passageway trough. Such sensing means can be a photodiode-light beam combination or an electromechanical switch appropriately positioned along the passageway trough.

The reading of the end code **12*b* also will deactivate the solenoid which raises the second gate 35. Since such code reading is not accomplished unless the leading lateral edge of the medicine package lies beneath the second gate 35 and unless the first gate 32 prevents the medicine package from being retracted, the second gate 35 will abut the cover 10 of the medicine package (and will not depend into the passageway trough) until the medicine package has been advanced to a position where the trailing lateral edge of the medicine package has passed the second gate 35**.

The cutting machine may be provided with means for preventing the solenoid from being activated to raise the second gate 35 except for a selected time duration, for example two seconds, after the main code **12*a* has been read. This feature of the cutting machine helps conserve the power of an energy source, such as a battery, used in activating the solenoid in the event that the package is not passed forward so that the end code 12*b* is read to deactivate the solenoid or to record permanently the information associated with the medicine package. This feature also prevents a person using the device from elevating the solenoid by the insertion of one package, retracting the package quickly, and then inserting a second package completely through the device (because the second gate 35 is raised) without having the second package code satisfy the conditions. It will be appreciated that if the package is not moved forward after the main code 12*a* is read, the conditions are satisfied, the second gate 35 is raised, and the time duration exhausted (so that the second gate 35 is lowered), then a lateral edge of the medicine package will lie beneath the first gate 32** whereby the medicine package may be retracted back through the mouth of the passageway.

As previously stated, in one embodiment of the present invention means are provided to prevent the solenoid from being activated to raise the second gate 35 unless the first gate 32 is in a raised position. It will be appreciated that if in this embodiment the package is retracted from the machine after main code 12*a* has been read, then the first gate 32 will depend into the passageway trough after the retraction of the package and consequently the solenoid will be deactivated. The power of the solenoid energy source will be conserved. Also, a second package cannot pass through the machine without satisfying the conditions.

In a further modification of this embodiment, means are provided for preventing the solenoid from being activated to raise second gate 35 except for a selected time duration, for example two seconds, after the first gate 32 is raised. This feature of the cutting machine helps conserve power of the energy source used in activating the solenoid in the event the package is not passed forward so that the end code 12*b* is read to deactivate the solenoid.

The cutting machine can also be utilized to record all characteristics concerning the opening of a medicine package such as the type and dosage of medicine, the time when the package was opened, etc. without regard as to whether any conditions for opening the package have been satisfied. In this mode of operation, the second gate 35 can be fixedly positioned out of the passageway trough or eliminated entirely. The position of the machine readable code and the scanner 34 are selected such that after the end code 12*b* is completely read by the scanner 34, the first gate 32 will have dropped into the passageway trough whereby the first reservoir forming depression 16 cannot move backward past the first gate 32. The scanner 34 will have read the main code 12*a*, and the computer controller will record in its permanent memory all of the information associated with the medicine package, including the time the end code 12*b* was read. Since after the end code 12*b* is read the package cannot be retracted back through the mouth of the passageway, the package can be removed from the cutting machine only by moving it forward past the knives 36. Consequently, it is reasonable to presume that the package was opened and the medicine contained therein was administered at the time the end code 12*b* was read. This embodiment of the invention can be utilized without an end code 12*b* if the distance between the main code 12*a* and the trailing edge of the medicine package and the distance between the scanner 34 and the first gate 32 are selected such that the first gate 32 drops into the passageway trough immediately after the main code 12*a* has been read by the scanner 34.

The cutting mechanism can be utilized in a variety of manners. For example, each nurse and each patient could be provided with a card, bracelet, ring, of the like provided with a machine readable code which identifies the nurse and the patient, respectively. The computer controller contained in the cutting machine or operatively connected to the cutting machine from a remote location would be programed with the complete medicine needs of each patient on the nursing unit. The nurse would periodically visit each patient for whom she has responsibility with the cutting machine and with a bin of medicine packages containing different varieties and quantities of medicine. Alternatively, each patient could be provided with a corresponding bin or bins in a locked condition at his bedside. The nurse would stop at each patient and with means (not shown) decipher the machine readable code on the nurse's card and on the patients bracelet within a selected time interval. (The unshown deciphering means could also read a machine readable code associated with a locked bin of medicine packages for unlocking the bin if the conditions for giving medication contained within the bin are satisfied.) In an alternate, less preferred embodiment of the invention, each nurse could be assigned a corresponding cutting machine, in which event, the nurse's code would be entered into the computer controller only a single time for a selected time duration and would not need to be entered again when the nurse gives medication to each patient. Such deciphering means would record the nurse's identification and the patient's identification in the temporary memory of the computer controller associated with the cutting machine. The computer controller would then display the complete medicine needs of the patient including such characteristics as: the type of medicine needed by the patient, the number of units of medication needed, the time when the patient was last given the medicine, etc. The nurse would then insert the first reservoir forming depression 16 of a medicine package containing the appropriate medicine into the cutting machine, again within a certain time interval after the nurse's machine readable code and the patient's machine readable code were deciphered. If the conditions for giving the patient the medicine contained within the package are satisfied, then the second gate 35 will be elevated out of the passageway trough by the solenoid, thereby allowing the medicine package to be advanced. Once the end code 12*b* has been read, then the time when the code of the medicine package was scanned and the characteristics of the medicine in the medicine package are permanently recorded in the computer controller. When the end code 12*b* has been read, the medicine package has moved to a position where it is prevented by the first gate 32 from being retracted from the cutting mechanism and can be released from the cutting mechanism only by sliding the first reservoir forming depression 16 past the blades 36. The duration of the aforementioned time intervals is selected so that one may reasonably presume that the nurse and patient are in close proximity with the cutting machine when the medicine package is passed through the cutting mechanism and so that it is reasonable to presume further that the nurse will thereafter promptly give the medicine to the patient. Since the strip of code bearing covering is disengaged from the medicine package, it is extremely difficult to repiece the medicine package after it has passed the blades 36 to present a code that the scanner 34 can decipher. If the cutting machine is provided with means for automatically collecting the strip of code bearing covering then it may be impossible to repiece the medicine package. After the nurse has completed the round of giving medications, the information recorded in the computer controller may be transferred to other electronic devices for storage or for printout. Alternatively the cutting machine may be operatively interconnected with wiring near a patient's bedside (such as the nurse call system or electrical wiring for lights or telephones) to a remotely located computer controller operatively interconnected to the same wiring while the process of passing the medicine package through the cutting machine is occurring. A coded electrical signal may be used to initiate and terminate the use of such wiring for this function.

If the cutting machine were used without the second gate 35, the nurse would operate the cutting machine in the same manner as just described, however, the medicine package could be opened without satisfying any conditions for giving the patient the medicine contained within the medicine package.

It should be appreciated that the stored information, especially when used with the identification and unlocking of a bin of medicine, can be used advantageously for inventory control and for monitoring theft of medicine.

Many patient functions such as pulse, blood pressure and temperature are currently monitored with electronic devices. The present invention contemplates that these functions may be analyzed by and recorded in the computer controller and might even be some of the conditions that must be satisfied before a medicine package can be severed by the cutting machine. So, for example, if a patient is prescribed a medicine to relieve high blood pressure and the patient for some reason has a dangerously low blood pressure when the nurse contemplates dispensing the medicine to the patient, then the controller can be programmed to prevent the medicine package from being severed and will display the unsatisfied condition—a minimum amount of blood pressure.

The cutting machine may also be used for outpatient care. Such use of the cutting machine would be similar to that already mentioned, however, the cutting machine could also be provided with an alarm when a certain medicine or a quantity of a certain medicine had not been taken within a selected time period. Such an alarm could comprise light or sound generating means mounted on the cutting machine or light or sound generating means located in a doctor's office and operatively interconnected through telephone lines or the like with the cutting machine. The alarm can also be included in or operatively connected to a cutting machine used for self administered medicine by hospital patients and even for hospital staff administered medicine.

The previously described construction of the medicine package of the present invention makes it very difficult to open the medicine package without passing the medicine package through the cutting machine. Furthermore, the cutting machine can require that the patient's machine readable identification code be read (or the patient's name or number be manually entered into the computer controller) before the medicine package is permitted passage therethrough. Thus, the medicine dispensing system comprising the medicine package and cutting mechanism is child proof, because it is unlikely that a child will be able to open the medicine package without passing it through the machine and because the child will not be able to pass it through the machine without having possession of the patient's code (which presumably is possessed by one or more responsible adults).

FIGS. 17 through 19 show yet another medicine package according to the present invention. The medicine package includes a covering and a single reservoir forming depression which contains medicine such as a pill. As shown in FIGS. 18 and 19, the reservoir forming depression may surround either a bottle cap or a bottle including its cap or a syringe, respectively, as previously described. The covering bears a machine readable code comprising a main code that indicates the characteristics of the medicine contained within the medicine package and an end code that indicates the position of the medicine package in the cutting machine. The cutting machine depicted in FIGS. 11 through 16 is modified to provide blades which will cut the medicine package along the lines 40, 42 depicted in FIG. 17*b*. Thus, one blade severs the medicine package immediately below the covering and substantially parallel with the covering, and the other blade cuts the medicine package through the covering where the code 12 is located so that the cover and the machine readable code are broken into two pieces, thus making it very difficult to reconstruct the machine readable code in a readable form. To assist severing along the line 42, the reservoir forming depression, instead of being completely rounded, may be provided with a relatively acute edge as shown in FIG. 17*c* that may be pressed against the blade to facilitate the initiation of severing. Movement of the medicine package along the passageway trough may be faciliated by extending a longitudinal end of the package to provide a handle 43, as best shown in FIGS. 17*b*, 18 and 19.

The medicine packages shown in FIGS. 18 and 19 would be opened with a cutting machine provided with a longitudinal, open channel along the length of the passageway trough so that the bottle or syringe can depend from the trough.

The medicine packages shown in FIGS. 17*a*, *b* and *c* might be designed such that the size of the single reservoir forming depression corresponds with the size of the medicine pill. Such medicine packages can be used with a standard size passageway trough by providing each medicine package with longitudinal extensions on each side of the reservoir forming depression, as shown in FIG. 20. The medicine package shown in FIG. 20 is characterized by a point "a" at one longitudinal end near the code, a point "d" at the other longitudinal end, a point "b" adjacent to the reservoir forming depression toward point "a", a point "c" adjacent to the reservoir forming depression toward point "d". The medicine package is designed so that point "a" abuts the inner wall of the passageway and point "c" abuts the outside wall of the passageway trough when the medicine package is inserted into the cutting machine. Also, the distance from point "b" to point "d" is greater than the distance from point "a" to point "c". This design will ensure that the medicine package is positioned porperly for the code to be read.

The code 12 is located at a fixed longitudinal distance from a point "a", so that the code 12 will be read by the scanner 34 and will be severed by the cutting means that cuts along line 40. Alternately the code 12 may be relatively wide in a longitudinal direction so that the code 12 will be read, but in such a case the code 12 should be rendered undecipherable by ink or heat warping, as will be more fully described later herein.

The medicine packages shown in FIGS. 17 through 19 can also be used with yet another modified version of the cutting machine shown in FIGS. 11 through 16. In such modified cutting machine a single knife or blade is positioned to cut the package along the line 42, but no blade is provided to cut along the line 40. Thus, the blade would sever the package immediately below the covering and substantially parallel to the covering. The cutting machine would also be provided with means for sensing the presence of the medicine containing depression of the medicine package at a selected location along the passageway trough. Such sensing means could comprise a photodiode-light beam combination or an electro-mechanical switch. In this embodiment of the invention, the information associated with the medicine package would not be permanently recorded and/or the second gate 35 would be prevented from being raised, unless the sensing means sensed the presence of the medicine containing depression in the passageway trough. Consequently, if someone were to pass or attempt to pass through the cutting machine only the top, cover portion of a medicine package already severed along the line 42, then the cutting machine would not record any information associated with the already opened medicine package.

In the embodiments where cutting of the medicine package occurs along the lines 40 and 42, a ring of wire similar to the previously discussed ring 23 could be placed in a position comparable to the position of ring 23 in FIGS. 1 through 10. Such a ring would discourage opening the package with conventional cutting means such as scissors, but would not interfere with the cutting of the medicine package along either line 40 or line 42, since line 42 would be above the ring. In the embodiments where cutting of the medicine package occurs along line 42 only, a ring of wire similar to the previously discussed ring 22 could be placed in a position comparable to the position of ring 22 in FIGS. 1 through 10. Such a ring would discourage opening the package with conventional cutting means, but would not interfere with the cutting of the medicine package along line 42, since line 42 would be below the ring.

FIG. 21 shows yet another medicine package according to the present invention. The medicine package includes a covering and a formed section including a single reservoir forming depression in which the medicine is deposited. The covering bears a machine readable code shaped in the circle. A cutting machine for the medicine package depicted in FIG. 21 is depicted in FIG. 22. The cutting mechanism includes a pair of opposing slots 50 into which the medicine package is slidingly received. The cutting mechanism includes means for deciphering the code, such as a scanner 52. The scanner 52 may be mounted on a shaft rotatable in a single direction. The shaft may be rotated by either electrical means or mechanical means (such as a handle) and includes a blade 54 selectively extendable by means not shown from a position away from the medicine package covering to a position where the blade 54 punctures the medicine package covering. If certain conditions are satisfied after the scanner 52 has read the code on the medicine package, then the blade 54 will be extended to puncture the medicine package covering and the shaft will be rotated through three hundred sixty degrees so that the blade 54 severs the covering in a complete circle. The blade 54 will be retracted only after it has rotated a full 360 degrees so that the medicine package cannot be withdrawn until the covering has been cut completely. The severed, circular portion of the medicine package covering contains a substantial portion of the machine readable code so that the medicine package cannot be reconstructed easily to provide a readable code. If the conditions are not satisfied, then the blade 54 will not be extended, and the medicine package will not be cut. The cutting machine shown in FIG. 22 may be provided with a computer controller display, etc. for performing the functions similar to those previously described.

The cutting machine shown in FIG. 22 may also be utilized to open the medicine package even when no conditions are satisfied. In this embodiment of the invention, the blade 54 would be extended in all but one radial position as the shaft is rotated, and the package would be inserted or withdrawn only when the blade 54 is in such one radial position. A ring of wire, fiberglass or other strong material would be placed in the package to prevent the package from being opened by conventional cutting means.

The present invention also contemplates that a portion of the code bearing covering need not be removed from the medicine package by cutting means in order to render the code undecipherable, but other means such as the application of ink over the code bearing covering or heat warping of the code bearing covering may be used to render the code undecipherable instead of a cutting means. Such ink application or heat warping means could be positioned on the tip of the second gate 35 in the cutting machine depicted in FIGS. 11–16. Also, if such ink application or heat warping means were utilized then only one knife 36 would be needed in FIGS. 11–16, and the arrangement of adhesive shown in FIG. 9 (with only a single cover) would be adequate. Similarly, if such ink application or heat warping were utilized then only the knife for cutting along line 42 of FIG. **17*b*** would be needed for that embodiment of the invention. Also, if the code comprises a magnetic code, then it may be rendered undecipherable by a magnet or other magnetic field producing means.

The present invention described herein has been described with reference to medicine and to bottles and syringes, however, it should be understood that the invention applies with equal effectiveness to a wide variety of objects.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than is specifically described above.

I claim:

1. A machine for opening a package, the package having a reservoir and bearing a code indicating information concerning the characteristics of the contents thereof, comprising:

means for guiding the code bearing portion of the package along a selected path;

means for deciphering the code as the code bearing package portion travels forward along the path; and means for cutting the package when the code bearing package portion travels forward along the path.

2. A machine according to claim 1 further including means for preventing the code bearing package portion from traveling backward along the path after the code has been deciphered by said deciphering means and wherein said cutting means cuts the package after the code has been deciphered by said deciphering means.

3. A machine according to claim 1 wherein the package contents comprise medicine.

4. A machine according to claim 1 wherein said guide means includes a trough having a shape conforming to the shape of the reservoir.

5. A machine according to claim 1 wherein said cutting means includes at least one knife.

6. A machine according to claim 2 wherein said preventing means selectively prevents the code bearing package portion from traveling backward after said code has been deciphered.

7. A machine according to claim 1 further comprising means for selectively preventing the package from being cut by said cutting means.

8. A machine according to claim 1 wherein said cutting means avoids contact with the package contents.

9. A machine according to claim 1 further comprising means for rendering the code substantially unreadable.

10. A machine according to claim 2 further comprising means to render the code substantially unreadable and wherein said rendering means includes said cutting means.

11. A machine according to claim 2 further comprising means for applying ink to the code to render the code substantially unreadable.

12. A machine according to claim 2 further comprising means for applying heat to the package to render the code substantially unreadable.

13. A machine according to claim 1 further comprising means for recording the information indicated by the code.

14. A machine for opening a package, the package having a reservoir and bearing a code indicating information concerning the characteristics of the contents thereof, comprising:

means for guiding the code bearing package portion to a selected position;

means for deciphering the code when the code bearing package portion is in the selected position; and means for cutting the code bearing package portion after the code has been deciphered by said deciphering means.

15. A machine according to claim 14 wherein said cutting means cuts the code bearing package portion when the package is in the selected position.

16. A machine according to claim 14 wherein the package contents comprise medicine.

17. A machine according to claim 14 wherein said cutting means cuts the code bearing package portion substantially along a circle substantially encompassing the code.

18. A machine according to claim 14 wherein said cutting means includes a knife operably connected to a rotatable shaft.

19. A machine according to claim 14 further comprising means for selectively preventing the package from being cut by said cutting means.

20. A machine according to claim 14 further comprising means for recording the information indicated by the code.

21. A machine according to claim 14 further comprising means to render the code substantially unreadable.

22. A machine for opening a package, the package provided with a code indicating information concerning the characteristics of the contents thereof, comprising:

means for deciphering the code to determine the characteristics of the contents;

means for rendering the code undecipherable; and means for opening the package.

23. A machine according to claim 22 wherein said deciphering means deciphers the code, said rendering means renders the code undecipherable, and said opening means opens the package substantially simultaneously.

24. A machine according to claim 22 wherein the package contents comprise medicine.

25. A machine according to claim 22 wherein said rendering means includes a supply of ink.

26. A machine according to claim 22 wherein said rendering means includes a source of providing heat.

27. A machine according to claim 22 wherein said rendering means includes means for cutting the package.

28. A machine according to claim 22 further comprising means for recording the information indicated by the code.

29. A machine according to claim 22 further comprising means for selectively permitting said cutting means to cut the code bearing package portion.

30. A machine according to claim 22 wherein said cutting means avoids contact with the package contents.

31. A machine for opening a package, the package provided with a code indicating information concerning the characteristics of the contents thereof, comprising:

means for guiding the package along a selected path;

means for deciphering the code as the package travels forward along the path; and means for opening the package as the package travels forward along the path.

32. A machine according to claim 31 further comprising means for preventing the package from traveling backward along said path after the code has been deciphered by said deciphering means.

33. A machine according to claim 31 further comprising means for rendering the code undecipherable after the code has been deciphered by said deciphering means.

34. A machine according to claim 33 wherein said rendering means includes a supply of ink.

35. A machine according to claim 33 wherein said rendering means includes means for providing heat.

36. A machine according to claim 33 wherein said rendering means includes means for cutting the package.

37. A machine according to claim 31 further comprising means for selectively permitting the package to travel forward along said path after the code has been deciphered by said deciphering means.

38. A machine according to claim 31 further comprising means for recording the information indicated by the code.

39. A machine according to claim 31 wherein said opening means avoids contact with the package contents.

40. A machine for opening a package, the package having a reservoir and bearing a code indicating information concerning the characteristics of the contents thereof, comprising:

means for guiding the code bearing portion of the package along a selected path;

means for deciphering the code as the code bearing package portion travels forward along the path;

means for preventing the code bearing package portion from traveling backward along said path after the code has been deciphered by said deciphering means;

means for permitting the code bearing package to travel forward along the path in response to said deciphering means after the code has been deciphered by said deciphering means; and means for opening the package when the code bearing package portion travels forward along the path after the code has been deciphered by said deciphering means.

41. A machine according to claim 40 further comprising means for rendering the code undecipherable.

42. A machine according to claim 40 further comprising means for recording the information indicated by the code.

43. A machine according to claim 40 wherein said opening means avoids contact with the package contents.

44. A machine for opening a package, the package provided with a code indicating information concerning the characteristic of the contents thereof, comprising:

means for guiding the package along a selected path;

means for deciphering the code as the package travels forward along the path;

means for preventing the package from traveling backward along said path after the code has been deciphered by said deciphering means;

means for permitting the package to travel forward along the path in response to said deciphering means after the code has been deciphered by said deciphering means;

means for rendering the code undecipherable after the code has been deciphered by said deciphering means; and means for opening the package.

45. A machine according to claim 44 further comprising means for recording the information indicated by the code.

46. A machine according to claim 44 wherein said opening means avoids contact with the package contents.

47. A machine for opening a package, the package having a reservoir and bearing a code indicating information concerning the characteristics of the contents thereof, comprising:

means for guiding the package along a selected path;

means for deciphering the code as the package travels forward along the path;

means for sensing the presence of the package reservoir at a selected point along the path;

means responsive to said deciphering means and to said sensing means for permitting the package to travel forward along the path;

means for preventing the package from traveling backward along the path; and means for opening the package.

48. A machine according to claim 47 further comprising means for recording the information indicated by the code.

49. A machine according to claim 47 further comprising means for rendering the code substantially unreadable.

50. A machine according to claim 47 wherein said opening means avoids contact with the package contents.

51. A machine for opening a package, the package having a reservoir and bearing a code indicating information concerning the characteristics of the contents thereof, comprising:

means for guiding the package along a selected path;

means for deciphering the code as the package travels forward along the path;

means for sensing the presence of the package reservoir at a selected point along the path;

means responsive to said deciphering means and said sensing means for recording the information indicated by the code;

means for preventing the package from traveling backward along the path;

means responsive to said deciphering means for permitting the package to travel forward along the path; and means for opening the package.

52. A machine according to claim 51 further comprising means for rendering the code substantially unreadable.

53. A machine according to claim 51 wherein said opening means avoids contact with the package contents.

54. A machine for opening a package, the package provided with a code indicating information concerning the characteristics of the contents thereof, comprising:

means for opening the package;

means for deciphering the code substantially instantaneously before said opening means opens the package; and means for recording the information indicated by the code substantially instantaneously before said opening means opens the package.

55. A machine according to claim 54 further comprising means for rendering the code undecipherable after the code has been deciphered by said deciphering means.

56. A machine according to claim 54 further comprising means responsive to said deciphering means for selectively preventing the package from being opened by said opening means.

57. A machine according to claim 54 wherein said opening means avoids contact with the package contents.

58. A machine for initiating the separation of two sheets of material attached to an object and secured together in a generally overlapping relationship, one of the sheets being provided with a code indicating information concerning the characteristics about the object, said machine comprising:

means for guiding the code bearing sheet portion to a selected position;

means for deciphering the code when the code bearing sheet portion is substantially in the selected position; and means for initiating the separation of the two sheets of material after the code has been deciphered by said deciphering means.

59. A machine according to claim 58 wherein said guiding means guides the code bearing sheet portion along a selected path and wherein the selected position is along the selected path and wherein said initiating means separates the two sheets of material as the code bearing sheet portion travels forward along the selected path.

60. A machine according to claim 58 further comprising means for rendering the code undecipherable after the code has been deciphered by said deciphering means.

61. A machine according to claim 59 further comprising means for selectively preventing the code bearing sheet portion from traveling backward after the code has been deciphered by said deciphering means.

62. A machine according to claim 58 further comprising means responsive to said deciphering means for selectively preventing said initiating means from initiating the separation of the two sheets of material.

63. A machine according to claim 58 further comprising means for recording the information indicated by the code.

64. A machine according to claim 60 further comprising means for selectively preventing the code bearing portion from traveling backward after the code has been deciphered by said deciphering means, means responsive to said deciphering means for selectively preventing said initiating means from initiating the separation of the two sheets of material, and means for recording the information indicated by the code.

65. A machine for opening a package, the package having a reservoir and bearing a code indicating information concerning the characteristics of the contents of the package, comprising:

means for deciphering the code and for opening the package in a substantially continuous operation.

66. A machine according to claim 65 further comprising means for rendering the code substantially unreadable.

67. A machine according to claim 65 further comprising means for recording the information indicated by the code.

68. A machine according to claim 65 wherein said deciphering and opening means avoids contact with the package contents.

69. A machine according to claim 65 wherein said deciphering and opening means avoids contact with the package contents.

70. A machine for initiating the opening of a package, the package having a reservoir and bearing a code indicating information concerning the characteristics of the contents thereof, comprising:

means for deciphering the code and for initiating the opening of the package in a substantially continuous operation.

71. A machine according to claim 70 further comprising means for rendering the code substantially unreadable.

72. A machine according to claim 70 further comprising means for recording the information indicated by the code.

73. A machine for initiating the separation of two sheets of material attached to an object and secured together in a generally overlapping relationship, one of said sheets being provided with a code indicating information concerning the characteristics about the object, said machine comprising:

means for deciphering the code and for initiating the separation of the two sheets of material in a substantially continuous operation.

74. A machine according to claim 73 further comprising meas for rendering the code substantially unreadable.

75. A machine according to claim 73 further comprising means for recording the information indicated by the code.

76. A machine according to claim 73 wherein said deciphering and initiating means avoids contact with the object.

77. A machine according to claim 73 further comprising means for selectively preventing said initiating means from initiating the separation of the two sheets of material.

78. A machine for initiating the opening of a package, the package having a reservoir and bearing a code indicating information concerning the characteristics of the contents thereof, comprising:

means for guiding the code bearing portion of the package along a selected path;

means for deciphering the code as the code bearing package portion travels forward along the path; and means for cutting the package when the code bearing package portion travels forward along the path.

79. A machine according to claim 78 further including means for preventing the code bearing package portion from traveling backward along the path after the code has been deciphered by said deciphering means and wherein said cutting means cuts the package after the code has been deciphered by said deciphering means.

80. A machine according to claim 78 wherein the package contents comprise medicine.

81. A machine according to claim 78 wherein said guide means includes a trough having a shape conforming to the shape of the reservoir.

82. A machine according to claim 78 wherein said cutting means includes at least one knife.

83. A machine according to claim 79 wherein said preventing means selectively prevents the code bearing package portion from traveling backward after said code has been deciphered.

84. A machine according to claim 78 further comprising means for selectively preventing the package from being cut by said cutting means.

85. A machine according to claim 78 wherein said cutting means avoids contact with the package contents.

86. A machine according to claim 78 further comprising means for rendering the code substantially unreadable.

87. A machine according to claim 79 further comprising means to render the code substantially unreadable and wherein said rendering means includes said cutting means.

88. A machine according to claim 79 further comprising means for applying ink to the code to render the code substantially unreadable.

89. A machine according to claim 79 further comprising means for applying heat to the package to render the code substantially unreadable.

90. A machine according to claim 78 further comprising means for recording the information indicated by the code.

91. A machine for initiating the opening of a package, the package provided with a code indicating information concerning the characteristics of the contents thereof, comprising:

means for deciphering the code to determine the characteristics of the contents;

means for rendering the code undecipherable; and means for initiating the opening of the package.

92. A machine according to claim 91 wherein said deciphering means deciphers the code, said rendering means renders the code undecipherable, and said opening means initiates the opening of the package substantially simultaneously.

93. A machine according to claim 91 wherein the package contents comprise medicine.

94. A machine according to claim 91 wherein said rendering means includes a supply of ink.

95. A machine according to claim 91 wherein said rendering means includes a source of providing heat.

96. A machine according to claim 91 wherein said rendering means includes means for cutting the package.

97. A machine according to claim 91 further comprising means for recording the information indicated by the code.

98. A machine according to claim 91 further comprising means for selectively permitting said cutting means to cut the code bearing package portion.

99. A machine according to claim 91 wherein said cutting means avoids contact with the package contents.

100. A machine for initiating the opening of a package, the package provided with a code indicating information concerning the characteristics of the contents thereof, comprising:

means for guiding the package along a selected path;

means for deciphering the code as the package travels forward along the path; and means for initiating the opening of the package as the package travels forward along the path.

101. A machine according to claim 100 further comprising means for preventing the package from traveling backward along said path after the code has been deciphered by said deciphering means.

102. A machine according to claim 100 further comprising means for rendering the code undecipherable after the code has been deciphered by said deciphering means.

103. A machine according to claim 102 wherein said rendering means includes a supply of ink.

104. A machine according to claim 102 wherein said rendering means includes means for providing heat.

105. A machine according to claim 102 wherein said rendering means includes means for cutting the package.

106. A machine according to claim 100 further comprising means for selectively permitting the package to travel forward along said path after the code has been deciphered by said deciphering means.

107. A machine according to claim 100 further comprising means for recording the information indicated by the code.

108. A machine according to claim 100 wherein said opening means avoids contact with the package contents.

109. A machine for initiating the opening of a package, the package having a reservoir and bearing a code indicating information concerning the characteristics of the contents thereof, comprising:

means for guiding the code bearing portion of the package along a selected path;

means for deciphering the code as the code bearing package portion travels forward along the path;

means for preventing the code bearing package portion from traveling backward along said path after the code has been deciphered by said deciphering means;

means for permitting the code bearing package to travel forward along the path in response to said deciphering means after the code has been deciphered by said deciphering means; and means for initiating the opening of the package when the code bearing package portion travels forward along the path after the code has been deciphered by said deciphering means.

110. A machine according to claim 109 further comprising means for rendering the code undecipherable.

111. A machine according to claim 109 further comprising means for recording the information indicated by the code.

112. A machine according to claim 109 wherein said opening means avoids contact with the package contents.

113. A machine for initiating the opening of a package, the package provided with a code indicating information concerning the characteristics of the contents thereof, comprising:

means for guiding the package along a selected path;

means for deciphering the code as the package travels forward along the path;

means for preventing the package from traveling backward along said path after the code has been deciphered by said deciphering means;

means for permitting the package to travel forward along the path in response to said deciphering means after the code has been deciphered by said deciphering means;

means for rendering the code undecipherable after the code has been deciphered by said deciphering means; and means for initiating the opening of the package.

114. A machine according to claim 113 further comprising means for recording the information indicated by the code.

115. A machine according to claim 113 wherein said opening means avoids contact with the package contents.

116. A machine for initiating the opening of a package, the package having a reservoir and bearing a code indicating information concerning the characteristics of the contents thereof, comprising:

means for guiding the package along a selected path;

means for deciphering the code as the package travels forward along the path;

means for sensing the presence of the package reservoir at a selected point along the path;

means responsive to said deciphering means and to said sensing means for permitting the package to travel forward along the path;

means for preventing the package from traveling backward along the path; and means for initiating the opening of the package.

117. A machine according to claim 116 further comprising means for recording the information indicated by the code.

118. A machine according to claim 116 further comprising means for rendering the code substantially unreadable.

119. A machine according to claim 116 wherein said opening means avoids contact with the package contents.

120. A machine for initiating the opening of a package, the package having a reservoir and bearing a code indicating information concerning the characteristics of the contents thereof, comprising:

means for guiding the package along a selected path;

means for deciphering the code as the package travels forward along the path;

means for sensing the presence of the package reservoir at a selected point along the path;

means responsive to said deciphering means and said sensing means for recording the information indicated by the code;

means for preventing the package from traveling backward along the path;

means responsive to said deciphering means for permitting the package to travel forward along the path; and means for initiating the opening of the package.

121. A machine according to claim 120 further comprising means for rendering the code substantially unreadable.

122. A machine according to claim 120 wherein said opening means avoids contact with the package contents.

123. A machine for initiating the opening of a package, the package provided with a code indicating information concerning the characteristics of the contents thereof, comprising:

means for initiating the opening of the package;

means for deciphering the code substantially instantaneously before said initiating means initiates the opening of the package; and means for recording the information indicated by the code susbstantially instantaneously before said initiating means initiates the opening of the package.

124. A machine according to claim 123 further comprising means for rendering the code undecipherable after the code has been deciphered by said deciphering means.

125. A machine according to claim 123 further comprising means responsive to said deciphering means for selectively preventing the package from being opened by said opening means.

126. A machine according to claim 123 wherein said opening means avoids contact with the package contents.

* * * * *